United States Patent [19]

Hodge

[11] Patent Number: 4,637,079

[45] Date of Patent: Jan. 20, 1987

[54] BACKFLOW PREVENTING ATTACHMENT FOR TOILETS

[76] Inventor: Robert R. Hodge, 3505 Burr St., Gary, Ind. 46408

[21] Appl. No.: 732,412

[22] Filed: May 9, 1985

[51] Int. Cl.[4] ..... E03D 11/00

[52] U.S. Cl. ..... 4/427; 4/441; 4/252 R; 4/435; 251/326

[58] Field of Search ..... 4/426, 427, 434, 441, 4/252 R, 435, 438, 439; 137/330, 333; 251/326, 328

[56] References Cited

U.S. PATENT DOCUMENTS

| | | | |
|---|---|---|---|
| 187,545 | 2/1877 | McEwan | 4/434 |
| 2,904,306 | 9/1959 | Bryant | 251/329 X |
| 2,977,975 | 4/1961 | Allen | 137/330 |
| 3,224,014 | 12/1965 | Pietrzak | 4/252 R |
| 3,232,577 | 2/1966 | Sargent | 251/326 X |
| 3,340,545 | 9/1967 | Sargent | 4/435 |
| 3,367,625 | 2/1968 | Fortune | 251/328 X |
| 3,583,675 | 6/1971 | Palmer | 251/326 X |
| 3,788,346 | 1/1974 | Fitzgerald | 137/330 |
| 3,860,973 | 1/1975 | Uyeda et al. | 4/435 X |
| 4,013,090 | 3/1977 | Taylor | 251/326 X |
| 4,402,093 | 9/1983 | Luker et al. | 4/205 |
| 4,432,387 | 2/1984 | Sims | 137/330 X |
| 4,434,967 | 3/1984 | Vanderburg | 251/328 |

*Primary Examiner*—Charles E. Phillips

*Attorney, Agent, or Firm*—Hill, Van Santen, Steadman & Simpson

[57] ABSTRACT

A toilet backflow preventing valve and toilet bowl support for mounting between a standard soil pipe mounting flange and drain horn of a standard toilet bowl supports the toilet bowl closely adjacent the floor level, receives standard toilet bolts clamping the valve between the toilet bowl and the soil pipe and has a manually actuated slide with an open position that does not obstruct flow and a closed position sealing the soil pipe to prevent blackflow into the toilet bowl. A feature includes O-ring seals for the opposite faces of the slide and relative rotation of the slide and seals to facilitate the sliding action without damaging the seals.

2 Claims, 8 Drawing Figures

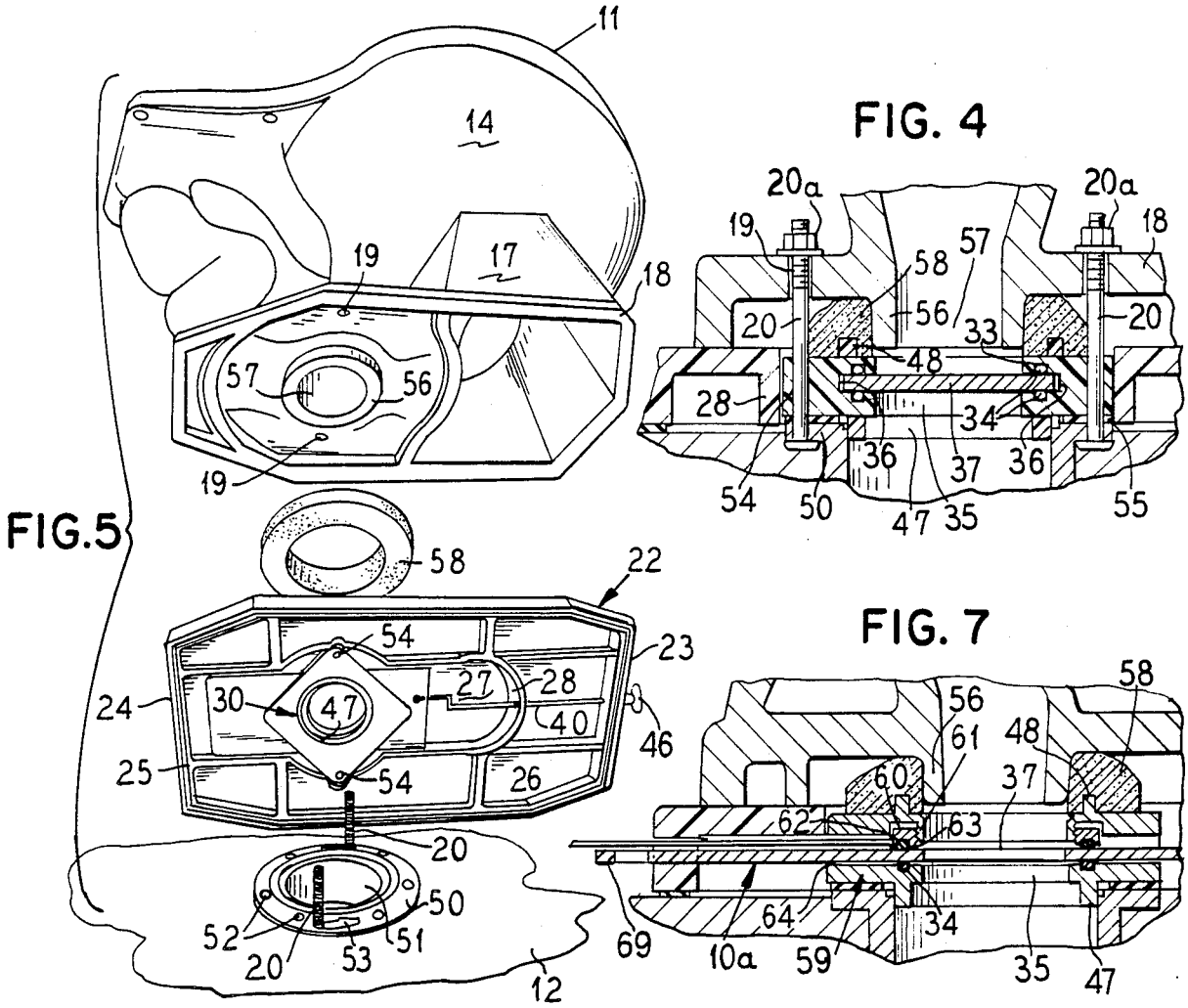
FIG. 4
FIG. 5
FIG. 7
11
14
17
18
19
20
20a
22
23
24
25
26
27
28
30
33
34
35
36
37
40
46
47
48
50
51
52
53
54
55
56
57
58
59
60
61
62
63
64
69
10a
12
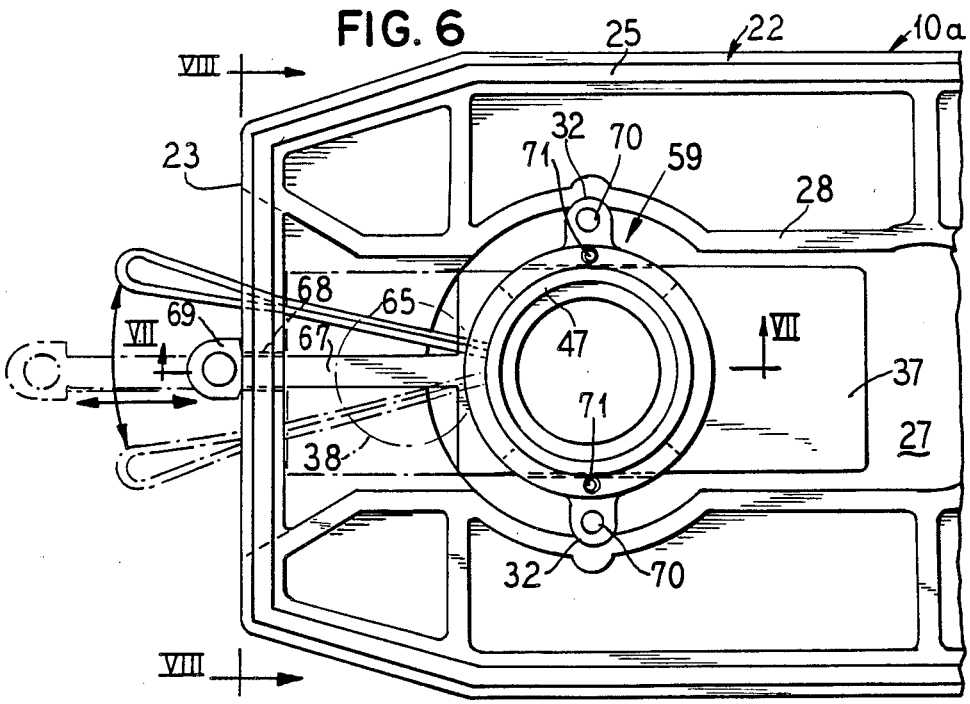
FIG. 6
VIII
VII
10a
22
23
25
27
28
32
37
38
47
59
65
67
68
69
70
71
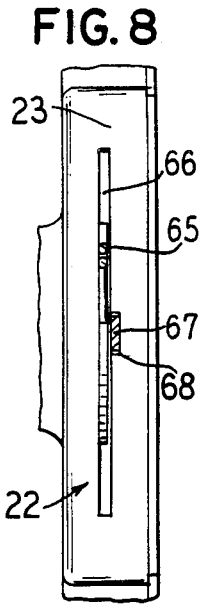
FIG. 8
22
23
65
66
67
68

BACKFLOW PREVENTING ATTACHMENT FOR TOILETS

BACKGROUND OF THE INVENTION

1. Field of the Invention

This invention relates to the art of backflow valves for toilets and specifically deals with a backflow slide valve attachment sandwiched between standard toilet bowls and soil pipes without appreciably raising the height of the toilet bowl.

2. The Prior Art

Backflow devices for toilets have heretofore required special toilet bowl constructions, revision of soil pipe constructions, and have presented obstacles to full drainage flow from the toilet bowl to the soil pipe.

It would be an improvement in this art to provide a relatively thin backflow preventing slide valve assembly capable of being sandwiched and clamped between a standard toilet bowl and a standard soil pipe and easily actuated without damaging seals.

SUMMARY OF THE INVENTION

According to this invention, there is provided a relatively thin slide valve assembly capable of being sandwiched and clamped between a standard toilet bowl and soil pipe flange by conventional draw bolts. The assembly includes a relatively thin flat annular base to rest on the floor around the mounting flange of a conventional soil pipe installation on the floor. The base freely receives a tubular slide valve housing or collar with a bottom face resting on the soil pipe flange and a depending ring or rim extending into the mouth of the soil pipe and adapted to be sealed therein. The top face of the housing has an upwardly projecting centering ring adapted to be pressed into the conventional wax or putty sealing ring for sealing the toilet drain horn to the soil pipe. The assembly is thus installed on the existing so-called closet collar flange of the soil pipe directly under a standard toilet without breaking floors, digging, cutting into sewer lines, or requiring special tools or equipment. The installation involves only the following steps:

1. Remove existing toilet, clean all gasket or putty materials from the bottom of the bowl and the existing closet collar flange on the soil pipe.

2. Apply a sealant such as a silicone adhesive, or putty, to the bottom side of the valve collar or housing from the outer side of the projecting centering ring to the outer edges. Sealant or putty can also be applied to the flat surface of the closet collar flange on the soil pipe.

3. Replace the existing closet collar studs or draw bolts with longer bolts to accommodate the added height or thickness of the valve body.

4. Place the valve body and raiser platform base assembly into position over the closet collar flange, tighten the valve body down on the flange.

5. Place a wax sealing ring onto the toilet outlet drain horn with the flat surface of the ring pointed downward. Place the toilet into position on the riser platform or base and valve with the collar bolts extending through the receiving holes of the toilet bowl base. Tighten the fastening nuts on the collar bolts to firmly clamp the valve housing between the soil pipe and toilet bowl horn with the toilet bowl resting on the riser or base platform.

The valve body has a central opening or bore therethrough of greater diameter than the drain outlet of the toilet bowl. This opening is bisected by transverse slots receiving the side edges of an elongated rectangular slide valve plate. Annular grooves are provided in the valve body around the opening or bore to receive O-rings which sealingly engage opposite faces of the valve plate.

The base or riser has a central opening sized for receiving the valve housing and slide valve. A pull rod with a knob on the end thereof slides through the base from the front end thereof and is attached to the slide valve plate in offset relation to the longitudinal axis of the valve. The slots supporting the slide valve plate in the housing are sufficiently deep to accommodate some lateral rocking of the valve plate. Then when the slide rod is initially pushed or pulled, the offset connection between the rod and valve plate will rock the plate laterally to break adhesion of the plate with the O-rings and the plate will then easily slide in the slots.

The valve plate has an aperture therethrough of the same or larger diameter than the opening or bore through the valve housing which registers with the bore in the rearmost position of the valve plate to fully open the drain connection between the bowl outlet and the soil pipe. When the valve plate is in its foremost position, the projected extension of the pull rod from the front end of the base or riser is a clear indication to the user that the valve is in closed position thereby warning against flushing of the toilet. When the valve plate is retracted to its open position, the knob of the pull rod will be bottomed on the base so as to be relatively unnoticed.

In a modification, one of the O-rings, such as the top ring, may be seated in the groove of a rigid ring housing which is threaded around an internal neck of the housing and a handle projects from this rigid ring through a slot in the front end of the riser base. The slide valve has a pull rod in the form of a flat strap extending through a slot in this front face. When it is desired to shift the slide valve between open end closed positions, the handle of the O-ring carrying rigid ring is swung in its slot to loosen the O-ring from tight engagement with the slide valve plate and the plate is thereby easily moved in its supporting slots by pushing and pulling the handle. The O-rings are thus protected against shear when the valve plate is shifted.

It is therefore an object of this invention to provide a backflow valve for standard toilet installations which is easily installed without revision of an existing toilet bowl and soil pipe structure.

A further object of this invention is to provide a backflow valve which is clamped and sealed between the base of a standard toilet bowl and the standard closet collar flange of a soil pipe.

A further object of this invention is to provide a slide valve backflow preventing installation for standard plumbing fixtures and toilet bowls which has O-ring seals tightly engaging the faces of the slide valve and a structure which relatively rotates the valve and at least one of the seals to facilitate sliding of the valve without damaging the seals.

A specific object of this invention is to provide a slide backflow valve for toilet bowls which is operated by a pull rod that initially circumferentially rocks the slide to break it away from the seals as it is shifted between open and closed positions.

Other and further objects of this invention will become apparent to those skilled in this art from the following detailed description of the annexed sheets of drawings which by way of best mode examples show two embodiments of the invention.

ON THE DRAWINGS

FIG. 4 is a cross-sectional view along the line IV—IV of FIG. 3;

FIG. 5 is an exploded perspective view of the components of the slide valve assembly showing the manner in which the valve assembly is installed between a standard toilet bowl and a standard soil pipe collar or flange;

FIG. 6 is a fragmentary bottom plan view of a modified slide valve assembly of this invention;

FIG. 7 is a cross-sectional view along the line VII—VII of FIG. 6;

FIG. 8 is a sectional view along the line VIII—VIII of FIG. 6

AS SHOWN ON THE DRAWINGS

Figure 1:
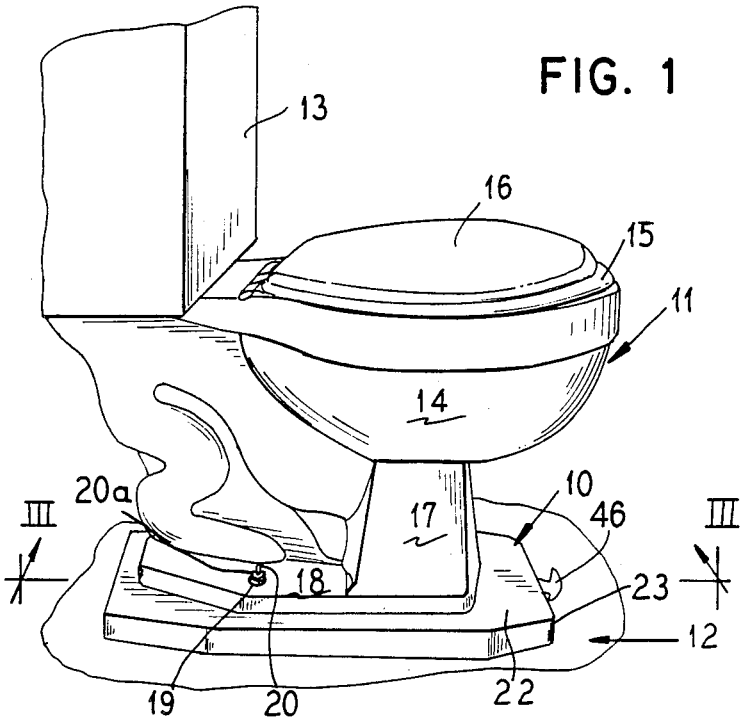
FIG. 1 is perspective view of a toilet installation equipped with a backflow control valve of this invention.

In FIG. 1 the reference numeral 10 designates generally a slide valve assembly of this invention mounted between a standard toilet bowl unit 11 and a floor 12. The toilet bowl unit 11 has a standard upstanding reservoir 13, an open top toilet bowl 14 receiving water from this reservoir, a seat 15 around the open top 14, a cover 16 for the seat 15, a depending pedestal 17, and a flat mounting base 18 with holes 19 therethrough receiving closet bowl draw bolts 20 with nuts **20*a* for anchoring the base 18 on the floor 12**.

Figure 2:
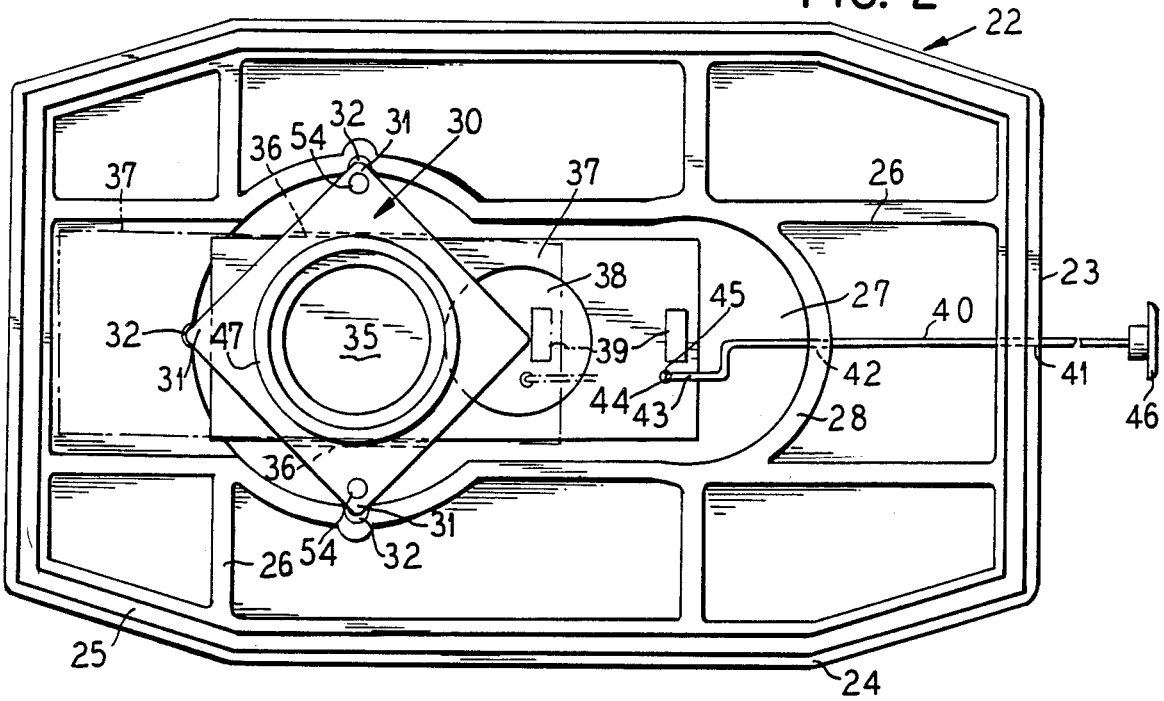
FIG. 2 is a bottom plan view of the slide valve assembly of this invention.

The assembly 10 of this invention has a relatively flat riser or base 22 sandwiched between the floor 12 and the toilet bowl base 18. This base 22 is generally rectangular in shape and projects beyond the periphery of the toilet bowl base 18 presenting a front end edge 23 retracted rearwardly from a front portion of a bowl 14 so as to not provide any obstruction. The base 22 only has a height of 1 to 2 inches so as not to materially raise the height of the toilet seat 15. As shown in FIG. 2, the base 22 is conveniently molded in one piece from a rigid plastics material or from a wooden slab coated with a resin such as a polyurethane. The base has a dependent peripheral rim 24 with a resilient gasket 25 secured to the bottom face thereof for gripping the floor 12 in tight sealing engagement therewith. Internal ribs 26 reinforce the base. A central elongated aperture 27 bounded by a peripheral rib wall 28 extends longitudinally through the central portion of the base rearwardly from the front edge 23.

A square valve housing or collar 30 fits in the aperture 27 and has three corners 31 thereof seated in recesses 32 of the upstanding peripheral wall 28 of the aperture. A relatively free fit is provided so that the base 22 may easily be slipped over the valve housing 30 after it is mounted on the flange of the soil pipe as hereinafter described.

The valve housing or body 30 is preferably composed of a plastics material such as a rigid polyvinyl chloride plastic and can be made in top and bottom halves with opposed faces having circular O-ring receiving grooves 33 seating sealing O-rings 34 around the central circular aperture or bore 35 through the valve body.

As shown in FIG. 2, the valve housing 30 has diametrically opposite corners 31 thereof seated in side recesses 32 of wall 28 with a rear corner 31 seated in end recess 32 thereby presenting the body to the aperture 27 in a diagonal or diamond shaped alignment. Open ended longitudinal grooves 36 extend front to rear through the body 30 on each side of the aperture at a level to intersect the peripheral seal grooves 33. A rectangular slide valve plate 37 fitting freely in the aperture 27 of the riser slides freely through these grooves 36 to be slidably supported by the housing 30. This plate 37 is conveniently formed from an acrylic resin and preferably has a teflon coating to reduce friction. It has a circular aperture 38 therethrough at least as large as the hole or bore 35 through the valve body 30. The top and bottom faces of the plate are sealingly engaged by the O-ring seals 34 in the grooves 33.

The slide plate 37 has a thickness substantially the same as the widths of the grooves 36, but the width of the plate is narrower than the space between the bottoms of these grooves so that the plate can cock or rotate laterally for a few degrees relatively to the valve body 30.

The front end of the plate 37 has an abutment strip 39 on the bottom face thereof to abut the valve housing at the end of its rearward stroke when the aperture 38 is fully aligned with the hole 35. Forward movement of the plate is stopped by the front rim wall 28 of the aperture before the rear end of the plate advances to the aperture 35 thereby preventing opening of the bore when the plate is pulled to its closed position. Alternately a stop, like 39, can be mounted on the rear end of the plate 37 to abut the housing 30 for limiting forward movement of the plate.

A pull rod 40 slides through a hole 41 in the front edge 23 of the base 22 and also through a hole 42 in the rim 28 surrounding the aperture 27. The rod 40 has a laterally offset leg 43 at its inner end with a hook 44 extending freely through a hole 45 in the valve plate 37. This hole 45 is offset from the longitudinal axis of the plate 37 being shown adjacent one side of the stop 39. The front end of the rod 40 projecting beyond the hole 41 has a knob 46 secured thereon.

The arrangement is such that when the knob is pushed or pulled, the rod 40 will slide through the holes 41 and 42 with the hook 44 on the offset leg 43 of the rod causing the plate to cock or swing laterally at the initiation of the sliding movement. This cocking or lateral shift breaks any seal bond which may have been established between the O-rings and the faces of the plate such as might occur during long periods of inaction since normally the plate will be in its retracted position to align its hole 38 with the bore 35 through the valve housing. The slide rotation prevents the O-rings from shearing or being pulled out of their grooves 34.

The bottom face of the valve housing or collar 30 has a centering ring or collar 47 depending therefrom around the aperture 35 with an inner diameter greater than the diameter of the aperture and with an outer diameter adapted to fit into a conventional soil pipe as will be hereinafter described. The top face of the valve body has a similar rigid ring or collar 48 projecting therefrom. The collar or ring 48 is larger than the ring 47 and has an inner diameter sized to be spaced not only from the hole or aperture 35 of the valve housing, but also from the drainage horn of the toilet bowl as will be hereinafter described.

As shown in FIG. 15, the floor 12 supports the conventional flange or collar 50 of a conventional soil pipe 51 extending through the floor. This flange or collar can be bolted to the floor by bolts or screws extending through holes such as 52 therethrough. In addition the collar has diametrically opposite bayonet slots 53 normally receiving the standard toilet bowl anchoring bolts or studs 20 which fit through the holes 19 in the base of the toilet bowl as described hereinabove. To accommodate the added thickness of the base 22 and the height of the valve housing 30, however, these conventional bolts are replaced with longer bolts 20 so as to extend through holes 54 of the valve housing 30 and then through the holes 19 of the toilet bowl base 18.

Figure 3:
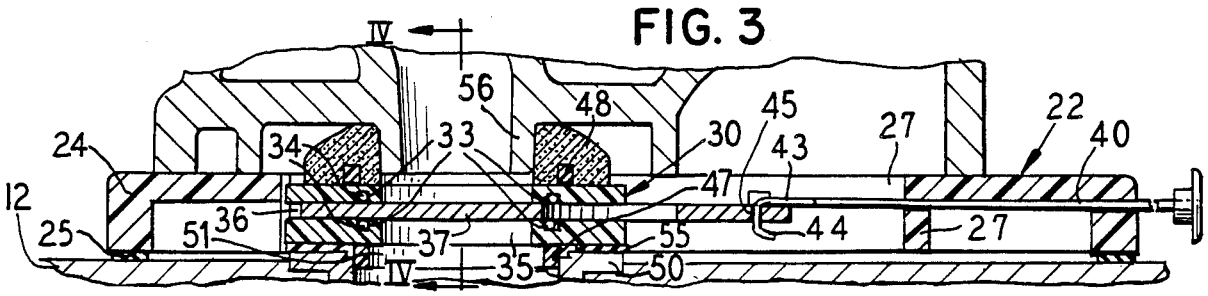
FIG. 3 is a cross-sectional view along the line III—III of FIG. 1.

The bottom ring 47 depending from the bottom face of the valve housing 30 fits into the mouth of the soil pipe 51 and is sealed to the collar 50 with a gasket and sealant 55 as shown in FIGS. 3 and 4.

The toilet bowl 14 has a conventional outlet horn 56 around the discharge outlet 57 thereof in the base 18. This horn is surrounded by a conventional collar of 58 of plumber's wax or putty. The horn, with the ring 58 therearound, is then aligned with the aperture 35 of the valve housing and the assembly is pressed down to embed the centering ring 48 on the top of the valve housing into the wax or putty. The bolts 20 are projected through the holes 19 of the base 18 and nuts **19*a* are threaded on these bolts to draw the centering ring 48 into the wax ring 58 and to thereby clamp and seal the valve housing to both the horn of the toilet bowl and the mounting flange of the soil pipe with the base 22 supporting the base 18 of the toilet bowl and with the gasket 25 on the base pressed firmly against the floor 12**.

In the open position of the slide valve, the knob 46 is pushed toward the front end 23 of the base 22 until the stop 39 abuts the valve housing at which position the hole 38 will be fully aligned with the bore or opening 35 through the valve housing. Then, when it is desired to close the valve, the knob 46 is pulled away from the front edge 23 until the slide is bottomed in the front end of the aperture 27. The extended position of the knob is clearly visible to warn a potential user of the toilet that the valve is closed.

The bottom centering ring 47 and the top centering ring 48 of the valve housing 30 may be color coded to prevent inadvertent reversal of the valve housing in the base.

In the embodiment **10*a* illustrated in FIGS. 6–8 the same reference numerals used in the above description of the embodiment 10** have been used to mark identical parts.

As shown, a modified valve housing 59 for the slide valve 37 has a circular groove 60 around the upper portion of the aperture or bore 35 with a threaded neck 61. A rigid ring 62 fits this groove and is threaded on the neck 61. This ring carries an O-ring seal 63 for engaging the slide valve 37 in the manner described in the embodiment 10.

The valve housing 59 mounts the bottom O-ring seal 34 in the same manner as in the embodiment 10.

A slot 64 is provided through the front face of the valve housing 60 and a handle 65 secured to the rigid ring 62 projects through this slot and forwardly through an aligned slot 66 in the front edge 23 of the base 22. Laterally shifting of the handle 65 on the threaded neck 61 thereby tightens the top O-ring seal 63 against or looses it from the top face of the slide plate 37.

The valve plate 37 has a flat strap handle 67 projecting from the front end thereof through a slot 68 in the front edge 23 of the base. A head 69 on the handle can be pushed or pulled to slide the valve plate in the housing 59. As illustrated, when the handle 67 is retracted to bottom the head 69 against the front edge, the valve is in its open position with the aperture 38 displaced forwardly from the bore 35 of the valve housing 60.

The valve housing has apertured ears 70 projecting into the recesses 32 of the base rim 28 and adapted to receive the mounting bolts or studs 20 therethrough.

The housing 59 is preferably formed in two halves with screws 71 clamping the two heads together to form the assembly. The housing has the bottom and top centering rings 47 and 48 the same as the valve housing 30 and the assembly is installed in the same manner as described in connection with the assembly 10. The housing 59, however, is preferably composed of metal.

From the above descriptions it will be understood that this invention now provides a backflow valve assembly which is easily installed between the base and soil pipe of a conventional toilet bowl installation without restricting flow in its open position and without requiring any revisions of standard plumbing fixtures or existing components except possible requirements for longer toilet bowl bolts 20.

I claim as my invention:

1. A backflow preventing valve for mounting on the top of a soil pipe flange by bolts bottomed in the soil pipe flange which comprises a housing overlying the soil pipe flange having a bore therethrough registering with the soil pipe and bolt holes receiving bolts extending from the flange, a valve plate with top and bottom faces mounted in said housing across said bore and slidable longitudinally in the housing, said valve plate having an aperture selectively aligned with and displaced from the bore to open and close the bore, O-rings mounted in said housing around said bore sealingly engaging the top and bottom faces of said valve plate in all positions of the plate, and a pull rod pivoted on the valve plate in offset relation to the longitudinal axis thereof effecting relative rotation of at least one O-ring and the valve plate to break the plate away from the O-rings as the rod is pulled to slide the plate between open and closed positions thereby preventing damage to the O-rings.

2. The valve of claim 1 including a thin annular base surrounding the valve housing for supporting the toilet.

* * * * *